US006319120B1

(12) United States Patent
Motosko

(10) Patent No.: US 6,319,120 B1
(45) Date of Patent: Nov. 20, 2001

(54) TIMED APPROACH SENSING GAME

(76) Inventor: Stephen Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 09/478,881

(22) Filed: Jan. 7, 2000

(51) Int. Cl.[7] ..... A63F 9/24
(52) U.S. Cl. ..... 463/7; 273/445; 273/446
(58) Field of Search ..... 273/445, 444, 273/446; 463/7, 35

(56) References Cited

U.S. PATENT DOCUMENTS

| | | | | |
|---|---|---|---|---|
| 3,960,379 | * | 6/1976 | Maloney et al. | 273/95 R |
| 4,533,144 | | 8/1985 | Juarez et al. | 273/311 |
| 4,961,575 | * | 10/1990 | Perry | 273/1 E |
| 4,973,052 | * | 11/1990 | Conti | 273/1 GC |
| 5,470,082 | | 11/1995 | Clayton | 273/445 |
| 5,901,961 | | 5/1999 | Holland, III | 273/445 |
| 6,149,490 | * | 11/2000 | Hampton et al. | 446/353 |

* cited by examiner

*Primary Examiner*—Michael O'Neill
*Assistant Examiner*—Steven Ashburn
(74) *Attorney, Agent, or Firm*—Charles J. Prescott

(57) ABSTRACT

An electronic game apparatus requiring skill in which one or more players individually attempt to outmaneuver the game apparatus on a time limit and motion or presence sensing detecting basis. Each player starts a play cycle of an electronic circuit within the game apparatus by manually pressing a start button on the housing. The player then has a preselected first period of time, e.g. five seconds, during which the presence sensor is deactivated to distance himself sufficiently from the game apparatus so that his presence would not be sensed by the motion detector of the apparatus at the end of the first time period. At the end of the first time period, the presence sensor is activated and the player has a certain second time period, e.g. ten seconds, to stealthfully reapproach the game apparatus without his or her presence being detected and to disarm the game apparatus by pressing a stop button or area of the housing. The player therefore loses if either the motion sensor is triggered or the second time period runs before the disarming stop button is depressed by the player. All forms of presence sensors, including optical motion detectors, sound detectors, infrared sensors and the like are within the intended scope of this invention.

1 Claim, 2 Drawing Sheets

TIMED APPROACH SENSING GAME

BACKGROUND OF THE INVENTION

1. Scope of Invention

This invention relates generally to electronic games of skill, and more particularly to a timed presence sensing game which challenges each player to stealthfully approach the game once it has been activated before a time period has run or a presence sensor causes the triggering of an alarm within the game apparatus.

2. Prior Art

Timed electronic games of a broad nature and array of features and operating rules are well known and marketed wherein each player is challenged to accomplish some athletic or physical feat within a predetermined time period. U.S. Pat. No. 5,901,961, invented by Holland, teaches a reaction speed timing and training system for athletes.

Clayton, in U.S. Pat. No. 5,470,082, teaches a game apparatus played by a plurality of players surrounding the game, each of which can deflect a stream of water randomly emitted from a nozzle toward each player. Another electronic game is disclosed in U.S. Pat. No. 4,533,144 invented by Juarez in which an electronic game is disclosed in which each player fires a hand-held target weapon at targets and then must evade simulated return fire directed at the player.

The present invention discloses a timed electronic game apparatus which tests the skill of one or more players who individually attempt to outmaneuver the presence sensor of the game apparatus on a timed and presence sensing basis. To start the game, one of the players activates a start member or switch on the exterior of the housing. The players then have a short first period of time, e.g. five seconds during which the presence sensing circuit is deactivated to distance themselves sufficiently from the game apparatus so that their presence would not be detected by the presence sensor within the housing of the game apparatus. Thereafter, each player is made aware by either audible or light emitting means on the housing that the first time period has ended and the presence sensing circuit has been activated. Thereafter, a second time period e.g. ten seconds, is provided during which one or more of the players may stealthfully approach the game apparatus so as not to activate the presence sensor and to manually activate a stop member on the housing.

If the stop member is activated during the second time period and without activating the presence sensor, the player has won the game. However, if the player's presence is either sensed during the second time period or the second time period ends without the player having activated the stop member, the player loses the game. Notification of loss is indicated by either a loud audible siren or light indicator.

BRIEF SUMMARY OF THE INVENTION

This invention is directed to an electronic game apparatus requiring skill in which one or more players individually attempt to out maneuver the game apparatus on a time limit and motion or presence sensing detecting basis. Each player starts the game apparatus by manually pressing a start button on the housing. The player then has a preselected first period of time, e.g. five seconds, during which the presence sensor is deactivated to distance himself sufficiently from the game apparatus so that his presence would not be sensed by the motion detector of the apparatus at the end of the first time period. At the end of the first time period, the presence sensor is activated and the player has a certain second time period, e.g. ten seconds, to stealthfully reapproach the apparatus without his or her presence being detected and to disarm the game apparatus by pressing a stop button or area of the housing. The player therefore loses if either the motion sensor is triggered or the second time period runs before the disarming stop button is depressed by the player. All forms of presence sensors, including optical motion detectors, sound detectors, infrared sensors and the like are within the intended scope of this invention.

It is therefore an object of this invention to provide an electronic timed game apparatus of skill in practicing a stealth approach to a presence sensing game apparatus.

It is another object of this invention to provide a timed presence sensing game apparatus in which a plurality of players may each attempt to deactivate the game apparatus during a short game activation period before other players do so and without triggering the presence sensor of the game apparatus.

In accordance with these and other objects which will become apparent hereinafter, the instant invention will now be described with reference to the accompanying drawings.

DETAILED DESCRIPTION OF THE INVENTION

Figure 1:
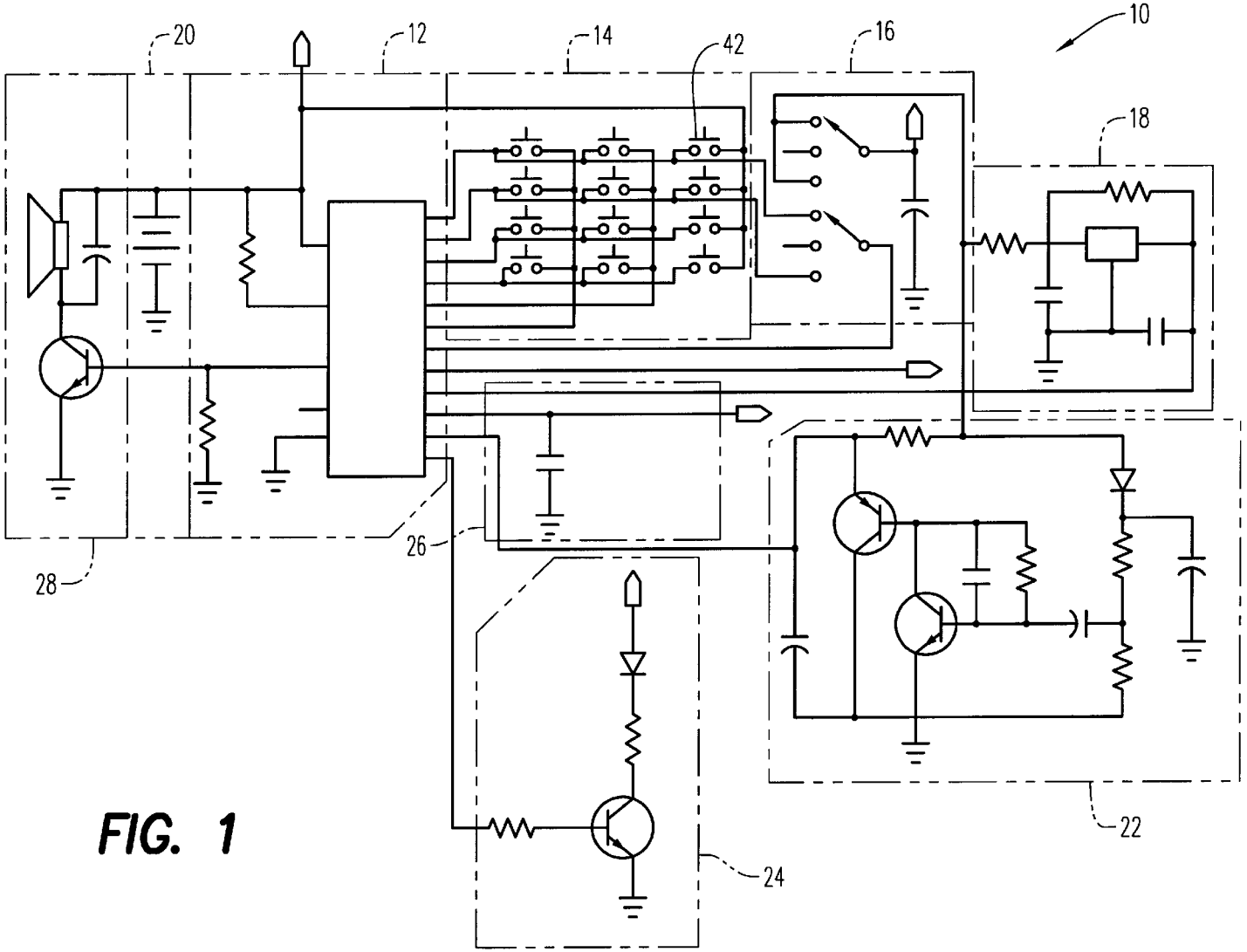
FIG. 1 is a schematic of an electronic circuit including the invention.

Referring now to FIG. 1, an electronic schematic circuit is shown generally at numeral 10 which includes the electronic features and functions of the present invention. This circuit 10 includes a main circuit control 12 having a conventional programmable CPU therein, a player input 14 including a plurality of pressable buttons 42 which allow for the programming of the main circuit control 12, and a power switch 16 which operably energizes or de-energizes separate portions of the circuit 10 and main control circuit 12.

Figure 2:
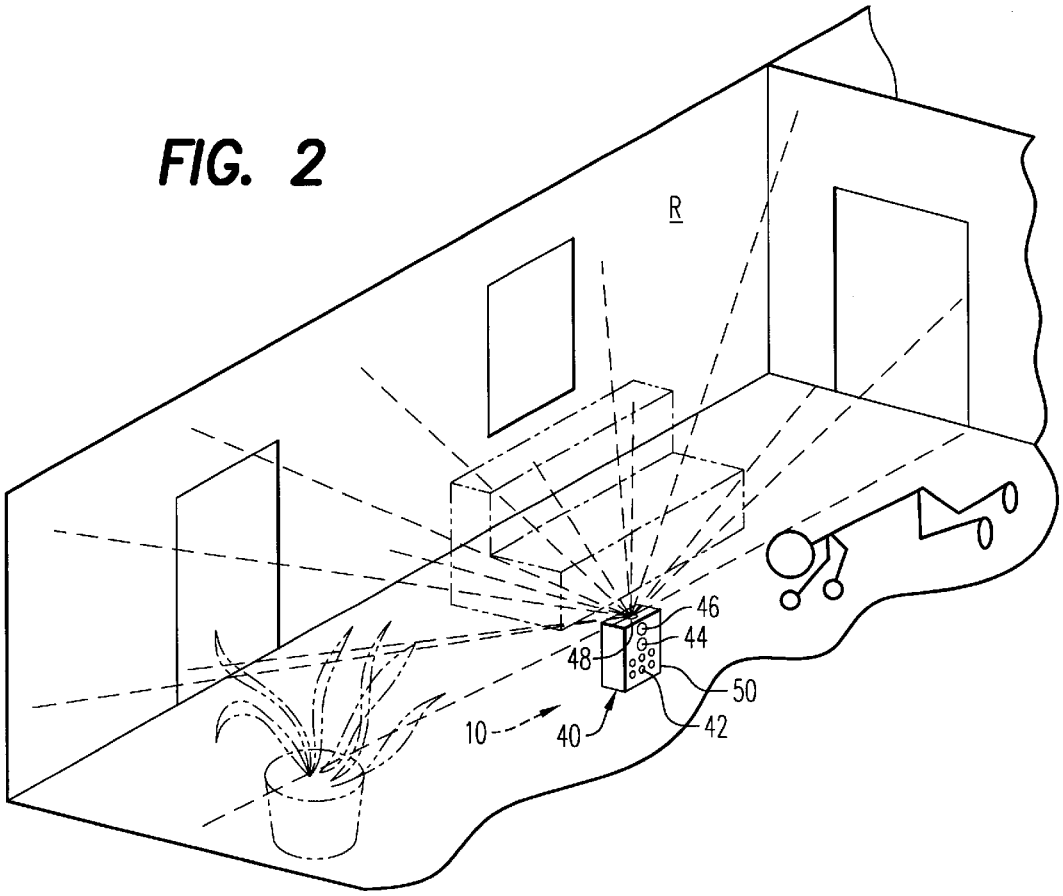
FIG. 2 is a simplified schematic perspective view of the invention in use within a room.

This circuit 10 further includes a voltage regulator portion 18, a battery source 20, a motion sensor 22, a motion sensor LED 24 which visually indicates that the motion sensor 12 has been activated by the presence of a player, and a vibration sensor 26 which triggers the audible alarm 28 if the housing 40 shown in FIG. 2 is upset, tipped or lifted.

Referring additionally to FIG. 2, the circuit 10 within a molded housing 50 of the game apparatus 40 is activated for play when a player starts the game by manually depressing one of the player input buttons 42 within player input section 14. This starts the running of a first short time period of, e.g., five seconds during which time the motion sensor circuit 22 having an optical sensor 48 is deactivated. At the end of this short first time period, an audible signal is heard from the audio indicator 28 to advise the player that the motion sensor 22 has been activated for a second time period e.g. ten seconds. It is during this second time period that the player, now initially starting out of reach of the motion sensor 22, begins a stealth reapproach to the game apparatus so as not to trigger the motion sensor 22. If the player is successful in reaching the game apparatus without triggering the motion detector 22, and depressing a stop member on the player input during the second time period, the player has won the game.

On the other hand, if the player, after the second time period has been activated and during which the motion sensor 22 is also activated, is not able to manually activate or depress the stop button of the player input panel 14 within the second time period, or if his presence is sensed by the motion sensor 22 during the second time period, the audible indicator 28 is activated to announce the loss of the game by that player.

In approaching the game apparatus 40 as shown in FIG. 2 which has been placed on a floor of a room R, each player may utilize static pieces of furnishings within the room R shown in phantom to help avoid being detected as he stealthfully approaches the game apparatus 40 so as to be able to depress the stop member 42 of the player input section 14 of circuit 10. In the preferred embodiment, the presence sensor 48 is in the form of an optical sensor. However, an infrared sensor 46 and a sound motion detector 44 may also be used, along with infrared sensors for sensing body heat as indicative of the presence or approach of one or more players of the game apparatus.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A timed approach sensing game apparatus comprising:

a housing;

an electronic circuit within said housing;

sensing means within said circuit for sensing the presence of a player within proximity to said housing while said sensing means is activated;

manually activated start and stop members each manually accessible on an exterior surface of said housing;

alarm means connected to said circuit for sounding an alarm only when said start member has been activated and only when said sensing means is activated and detects the presence of the player;

first timing means within said circuit for deactivating said sensing means for a predetermined first time period during which the player may quickly move out of the effective sensing range of said sensing means, said timing means activated by manually actuating said start member;

second timing means within said circuit for automatically activating said sensor means for a second time period immediately following the end of said first time period;

said stop member operably connected to said circuit for allowing the player to stealthfully approach the apparatus without activating the sensing means to deactivate said sensor means or otherwise disarm said alarm means during said second time period while said sensing means is activated;

said circuit automatically activating said alarm means if said stop member has not been manually activated by the player at the end of said second time period to indicate that the player has lost.

* * * * *